US008193665B2

(12) United States Patent
Eiden et al.

(10) Patent No.: US 8,193,665 B2
(45) Date of Patent: Jun. 5, 2012

(54) MULTI-PROTOCOL FIRE-ALARM STROBE SYNCHRONIZATION

(75) Inventors: Karl Eiden, Monticello, MN (US); Glenn Wontorcik, Corcoran, MN (US); Jeff Hendrickson, Elk River, MN (US)

(73) Assignee: Potter Electric Signal Company, LLC, Hazelwood, MO (US)

( * ) Notice: Subject to any disclaimer, the term of this patent is extended or adjusted under 35 U.S.C. 154(b) by 399 days.

(21) Appl. No.: 12/479,369

(22) Filed: Jun. 5, 2009

(65) Prior Publication Data

US 2010/0191507 A1 Jul. 29, 2010

Related U.S. Application Data

(60) Provisional application No. 61/146,990, filed on Jan. 23, 2009.

(51) Int. Cl.
*H05B 41/30* (2006.01)

(52) U.S. Cl. ..... 307/157; 307/40

(58) Field of Classification Search ..... 307/157
See application file for complete search history.

(56) References Cited

U.S. PATENT DOCUMENTS

| | | | | |
|---|---|---|---|---|
| 5,598,139 | A | 1/1997 | Karim et al. | |
| 5,659,287 | A * | 8/1997 | Donati et al. | 340/331 |
| RE38,183 | E | 7/2003 | Kosich et al. | |
| 6,789,208 | B2 * | 9/2004 | Noda et al. | 713/323 |
| 7,920,053 | B2 * | 4/2011 | Pattok et al. | 340/331 |
| 2007/0273511 | A1 * | 11/2007 | Clary | 340/565 |

OTHER PUBLICATIONS

ADA Compliant Notification Appliance Circuit Power Extender Autocall AL802UL-ADA, Grinnell Fire Protection, copyright 2002.*

Potter PSN Series Power Supply, Potter Electric Signal Company, Jul. 2011.*

FireForce 8 NAC Expander/Power Supply, Gamewell-FCI, a Honeywell Company, copyright 2007.*

* cited by examiner

*Primary Examiner* — Fritz M Fleming

(74) *Attorney, Agent, or Firm* — Lewis, Rice & Fingersh, L.C.

(57) ABSTRACT

A system and method of synchronization protocol for fire alarm strobe systems which has the ability to synchronize the strobe light devices from different manufactures simultaneously.

10 Claims, 8 Drawing Sheets

MULTI-PROTOCOL FIRE-ALARM STROBE SYNCHRONIZATION

CROSS REFERENCE TO RELATED APPLICATION(S)

This application claims benefit of U.S. Provisional Patent Application Ser. No. 61/146,990 filed Jan. 23, 2009, the entire disclosure of which is herein incorporated by reference.

BACKGROUND

1. Field of the Invention

This invention relates to the field of fire alarm strobe light control systems and other strobe light systems, particularly to systems which allow for disparate strobe triggered devices to provide light pulses simultaneously.

2. Description of the Related Art

Epilepsy is a common chronic neurological disorder characterized by recurrent unprovoked seizures that affects more than three million Americans. For about three (3) percent of them (approximately two per 10,000 of the general population), exposure to flashing lights at certain intensities or in certain visual patterns can trigger seizures. This condition is known as photosensitive epilepsy and is most common in children and adolescents.

The visual triggers for photosensitive epileptic seizures are generally cyclic visual cues that form a regular pattern in time and space. Flashing lights, commonly known as "strobes" or "strobe lights," are examples of patterns in time that can trigger photosensitive epileptic seizures and, in fact, these are the most common triggers.

While strobes can have a negative adverse affect on those individuals susceptible to photosensitive epileptic seizures, they are also are beneficial to the general population in a wide variety of scientific, industrial and commercial applications. For example, strobe lights are used in the entertainment industry, such as in clubs and in video games, to give an illusion of slow motion (i.e., the stroboscopic effect). Other applications for strobe lights are in the public safety field due to the inherent ability of flashing lights to attract visual attention. For example, strobe lights are used in alarm systems, in law enforcement and other emergency vehicles, and even in aircraft anti-collision lighting, among other applications. In fact, use of strobe lighting in fire alarm systems is mandated by the American Disabilities Act (the "ADA"), which states that workplaces and places serving the public are required to have fire alarms which flash as well as ring so that individuals who can not hear or have impaired hearing function are alerted to the emergency situation.

While strobe lighting used in the aforementioned entertainment applications can be avoided by those subject to potential photosensitive epileptic seizures, strobe lighting used in public safety applications is not as easily avoided. In recognition of the potential of strobes utilized in these emergency and public safety applications to initiate seizures, the ADA mandates that fire alarm strobe signaling devices be synchronized to inhibit the triggering of seizures in individuals suffering from photosensitive epilepsy. By providing synchronization and specific strobe timing, the potentially dangerous interaction between different flashing devices used in alarm systems is virtually eliminated and, so long as specific flash patterns are utilized, the triggering of photosensitive epileptic seizures is generally inhibited.

The UL 1971 standard, "Signaling Devices for the Hearing Impaired," is generally the synchronization and timing standard for visual notification devices utilized by those involved in the industry to provide safer strobe warning devices and systems. Specifically, this standard requires that all visible signaling devices triggered by the same event flash within a 0.01 second time frame and maintain a one- to two-hertz flash rate (one to two flashes per second).

In order to ensure compliance with the UL 1971 industry standard and the mandates of the ADA, manufacturers of the visual notification aspects of alarm and public safety systems define a specific method of powering and controlling individual strobe lights within the system as a whole such that each strobe flashes in-sync within the confines of the UL 1971 standard (i.e., within a 0.01 second time frame and at the specified cyclic rate). This method of synchronization, and the process and signal utilized to implement it, is typically referred to as a "Synchronization Protocol" within the industry. For example, in a fire alarm system, the synchronization protocol signal is generally generated by a synchronization supply expander designed for use with that manufacturer's strobes, or a fire alarm control panel similarly designed for use with the strobe system.

Several different companies manufacture strobe signaling devices for fire alarm applications and each traditionally has utilized a unique synchronization protocol to control and synchronize the operation of its strobe signaling devices. While these strobe signaling devices provide companies with assurance that their unique synchronization protocol will work with their own manufactured strobe signaling devices, it has left the consumer with a lack of commercial options. For example, since the synchronization protocol is specific to the company's strobe signaling products and fire alarm applications, generally a particular companies synchronization protocol can only be utilized with that company's strobe and fire alarm products. This means that the end consumer is often shoe-stringed into the types of devices they can use—i.e., they can only use those devices sold by the manufacturer of the synchronizing protocol system. This forced collective purchase robs the consumer the bargaining power of competition and choice in the marketplace; they cannot shop for the best price and value for each component of the alarm system (i.e., buying the individual strobes and synchronization protocol from different manufacturers).

For example, the current status of synchronizing protocol systems in the industry generally function as follows. As indicated above, the flash/strobe characteristics of alarm and visual notification devices utilized in emergency applications are generally controlled via a synchronization protocol. Generally, this protocol is generated by interrupting the power source to the strobe devices with brief synchronization pulses (a.k.a. "sync pulses"). These sync pulses are imposed by the power supplying device (e.g., a synchronization module, fire alarm powder expander or firm alarm control panel), and are detected by the visual notification device. By means of these pulses, the timing of the strobe flash of each individual light can be controlled.

Generally, to maintain the UL 1971 requirement that the flash rate be between one- to two-hertz, the pulses are issued at a one second nominal rate. As show in FIG. 1 however, the relationship between the sync pulse and the timing of the resultant strobe flash can be different depending on the design and operation of the different manufacturer's systems. This timing discrepancy between manufacturers is exemplified in FIG. 1. As shown, the period of time after the start of the receipt of the sync pulse until the strobe flash begins is different between the systems of Manufacturer A and Manufacturer B. For Manufacturer C, the difference is even more pronounced as this manufacturer uses the tail, instead of the start, of the sync pulse to synchronize the resultant flashes.

Thus, each manufacturer uses a different time period of the strobe flash of its strobe flashing devices to time and synchronize the system.

Historically, therefore, the only method of meeting UL 1971 requirements was to use strobe (and control) devices from only one manufacturer in a given installation—the individual strobe lights and the synchronization protocol used to sync them must be from the same manufacturer as otherwise the disparate timing of different manufacturers would result in the single timing signal producing out of sync flashes, as the separate strobe lights would flash out of sync with each other. This restriction limits flexibility in both new system installation, where a consumer generally has to select a single manufacturer's products, and in retrofit applications. Further, it inherently requires the time and cost associated with 1) ascertaining the manufacture of the strobe; and 2) figuring out the particular synchronization protocol utilized by the manufacturer of said devices. Retrofit applications can be particularly problematic because in such a situation the original manufacturer may no longer exist or may no longer use the same synchronization methodology. In this situation, a retrofit may require replacement of completely functional devices simply because they cannot be used in conjunction with new components Thus, both the cost and time associated with the installation and/or retrofit/restoration of sync-ed strobe light public safety alarm systems is needlessly augmented.

SUMMARY

The following is a summary of the invention in order to provide a basic understanding of some aspects of the invention. This summary is not intended to identify key or critical elements of the invention or to delineate the scope of the invention. The sole purpose of this section is to present some concepts of the invention in a simplified form as a prelude to the more detailed description that is presented later.

Because of these and other problems in the art, described herein are, among other things, a device for the creation of a synchronization protocol for the synchronization of strobe light devices from different manufacturers comprising: a power supply; a plurality of circuits each linked to a channel of different manufacturer strobe lights; and a trigger; wherein a power supply is programmed to indicate a specific synchronization protocol for each of said channels of different manufacturer strobe lights; wherein when said trigger is activated, said plurality of circuits are activated; wherein each circuit generates a specific a synchronization protocol for the channel of different manufacturer strobe lights attached thereto based on the specific sync pulse signal timing methodology used by each of said channel of different manufacturer strobe lights; and wherein said specific synchronization protocol from each of said circuits for each of said channels of different manufacturer strobe lights results in said channels of different manufacturer strobe lighting devices flashing in sync.

In an embodiment of the device the trigger may be an on/off trigger or a sync follow trigger.

In an embodiment of the device said synchronization protocol generated by said circuits will meet the UL 1971 timing requirements for all of said channels of different manufacturer strobe lights in said device.

There is also described herein, a method of synchronization protocol for the synchronization of strobe light devices from different manufacturers comprising: determining the timing discrepancy between the synchronization protocol of different manufacturer strobe lights; taking said determination of the timing discrepancy and using it to program a power supply to indicate a unique synchronization protocol signal to each of a plurality of circuits, each protocol signal specific to the channel of different manufacturer strobe lights attached to each of said circuits; activating a trigger; activating said circuits through the activation of said trigger; and generating said unique synchronization protocol signal from said circuits for each of said channels of different manufacturer strobe lighting devices based on the specific sync pulse signal timing methodology used by each of said different manufacturer strobe lighting devices; wherein said unique synchronization protocol from said each of said circuit for each of said channels of different manufacturer strobe lights results in said channels of different manufacturer strobe lights flashing in sync.

In an embodiment of the method, said synchronization protocol generated by said output circuits will meet the UL 1971 timing requirements for all of said different manufacturer strobe lighting devices in said system.

There is also described herein a method for creating a synchronization protocol for the synchronization of strobe light devices from different manufacturers in which a trigger pulse unrelated to any of said strobe light devices from different manufacturers is utilized, comprising: waiting for a trigger to activate; verifying the said trigger is present for a minimum period of time; waiting for the leading edge of the first sync pulse, taking the time-stamp "period_start;" waiting for a trailing edge of the first sync pulse, determining the width; if said trailing edges is not detected, then determining that the input trigger is off and reverting back to said step of waiting for the trigger to activate; if said trailing edged of the first sync pulse is detected, then waiting for the leading edge of the sync pulse; calculating the period; taking a new time-stamp for the "period_start"; synchronizing the output pattern generator to coincide with the leading edge of the input trigger; applying the measured period to any active outputs; taking a time-stamp, waiting for the trailing edge of the sync pulse to determine pulse width; if said trailing edge is detected, reverting back to said step of waiting for the leading edge of the sync pulse; and if said trailing edge is not detected, then determining that the input trigger is off and reverting back to said step of waiting for the trigger to activate.

There is also described herein a device for the determination of the synchronization protocol of strobe light devices from different manufacturers, comprising: an synchronization input signal from said strobe light devices from different manufacturers; a photocell that captures the strobe flash of said strobe light devices from different manufacturers; an oscilloscope that captures said strobe flash and said synchronization input signal and analyzes said strobe flash and said synchronization input signal to determine the tFlash value of said strobe light devices form different manufacturers.

There is also described herein a device for the verification of a synchronization protocol system with compliance requirements, comprising: a photocell; an embedded processor; and a fire alarm strobe system; wherein said photocell detects incoming light flashes from at least one strobe device of said fire alarm strobe system; wherein said photocell transfers flash rate and timing data regarding said incoming light flashes to said embedded processor; and wherein said embedded processor analyzes said flash rate and timing data to produce a measurement and pass/fail determination.

In an embodiment, the device further comprises: a personal computer, wherein said pass/fail determination is transferred and logged into said personal computer for storage and later analysis.

DESCRIPTION OF THE PREFERRED EMBODIMENT(S)

The following detailed description illustrates by way of example and not by way of limitation. Described herein, among other things, are synchronization protocol systems and methods which can synchronize the strobe light devices from different manufacturers simultaneously.

As a preliminary matter, to further the understanding of the scope of the disclosed systems and methods, it is noted that the term "strobe," "strobe flash," or "strobe lighting" as utilized in this disclosure shall broadly be interpreted to mean any device known to those of skill in the art to produce regular flashes of light. Moreover, while particular embodiments of the methods and systems for strobe synchronization discussed herein are generally discussed in the context of a fire alarm or emergency alert systems, it should be understood by the reader that use of the systems and methods disclosed herein is contemplated with any strobe lighting system known to those of skill in the art, whether that system be for public safety, or any other commercial or industrial application.

It is also prudent to note that it is contemplated that the systems and methods described herein can be realized in software, such as, but not limited to, instructions placed on a computer readable memory; hardware, such as, but not limited to, hardwired circuits; or a combination of both. In addition, the systems and methods described herein may also be utilized in control systems which are designed to stand alone or which may be utilized in more universal systems such as general security control systems.

Generally, described herein are multiple different embodiments which provide for two different configurations of a system which utilize a similar methodology to synchronize the strobes from a plurality of different manufacturers in such a manner that they flash in-sync. The first embodiment that will be described comprises a simple on/off trigger source to initiate the activation of strobe devices. The second embodiment that will be described uses a "sync follow" trigger.

Figure 2:
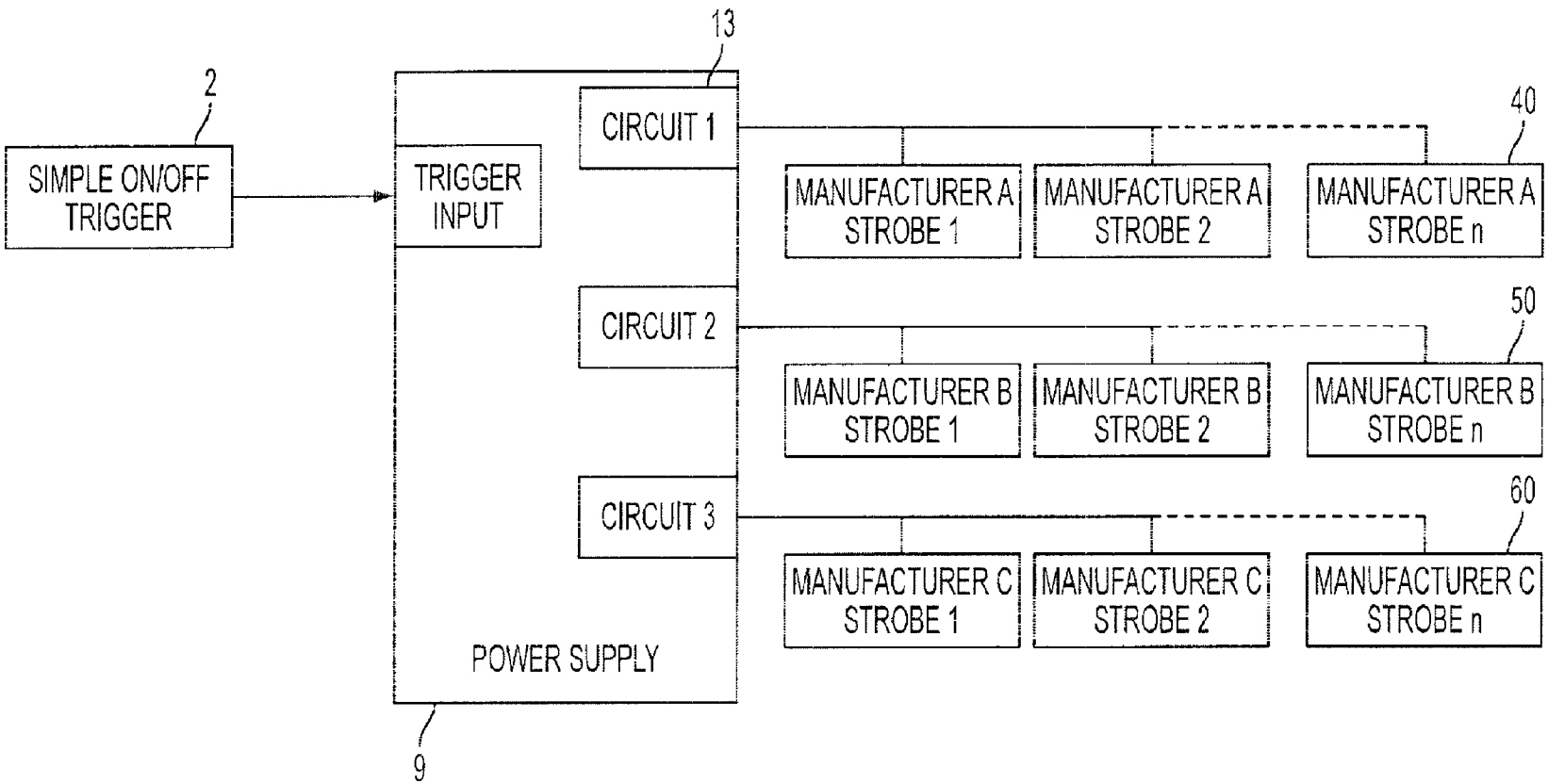
FIG. 2 provides a block diagram of an embodiment of a control system utilizing a simple trigger.

In one embodiment of the disclosed synchronization system and method, a simple on/off trigger (2) is utilized to initiate the activation of the strobe devices (40), (50), and (60) of different manufacturers, resulting in synchronization. FIG. 2 provides an embodiment of this simple trigger based system.

As a preliminary note, the term "trigger," as it is used in this embodiment, shall be deemed to encompass any procedural code known to those of skill in the art now, or in the future, utilized in software programming (e.g., a procedural code that is automatically executed in response to certain events on a particular table in a database) As depicted in FIG. 2, when the trigger (2) of this embodiment is activated, the output circuits (13) are activated. Of note, any output circuits known to those of skill in the art for software programming or hardware design are contemplated. For pictorial purposes, three output circuits (13) are shown in the diagram of FIG. 2, however, activation of any number of output circuits (13) is contemplated and generally there would be one circuit for each manufacturer whose strobes (40), (50) and (60) are used in the system. Each of the output circuits (13) activated by the trigger (2) feed a distinct synchronization signal to each channel of strobe lighting devices from a different manufacturer (40), (50), and (60), each of said strobe lighting devices having a different timing methodology.

During installation of the present embodiment, the installer will program the power supply system (9) to indicate the required protocol for the different strobe lighting devices (40), (50), and (60) utilized on each of the output circuits (13). Generally, any power supply system known to those of skill in the art for use with software applications is contemplated in this disclosure. It is contemplated that this programming at the installation stage can be accomplished by any way known to those of skill in the art for programming a power supply system (9). For example, in one embodiment, this programming is accomplished via configuration switch settings or by using generally known software programming tools. Based on this programming, the power supply system (9) will cause each output circuit (13) to generate an appropriate synchronization pulse for each channel of strobe signaling devices based on the manufacturer who built the devices which are placed on that channel and the specific sync pulse signal timing methodology that particular manufacturer utilizes. It is contemplated that the synchronization pulses generated by the output circuit(s) (13) will be generated in such a way as to meet the UL 1971 timing requirements not only for a single manufacturer's devices, but for all manufacturers in the system. As all trigger systems known to those of skill in the art used in software programming are contemplated, this trigger could be as simple as a relay closure, or as sophisticated as a software command sent over a communications interface. Thus, the essence of the concept of the simple trigger methodology disclosed herein does not depend on the implementation details.

Figure 3:
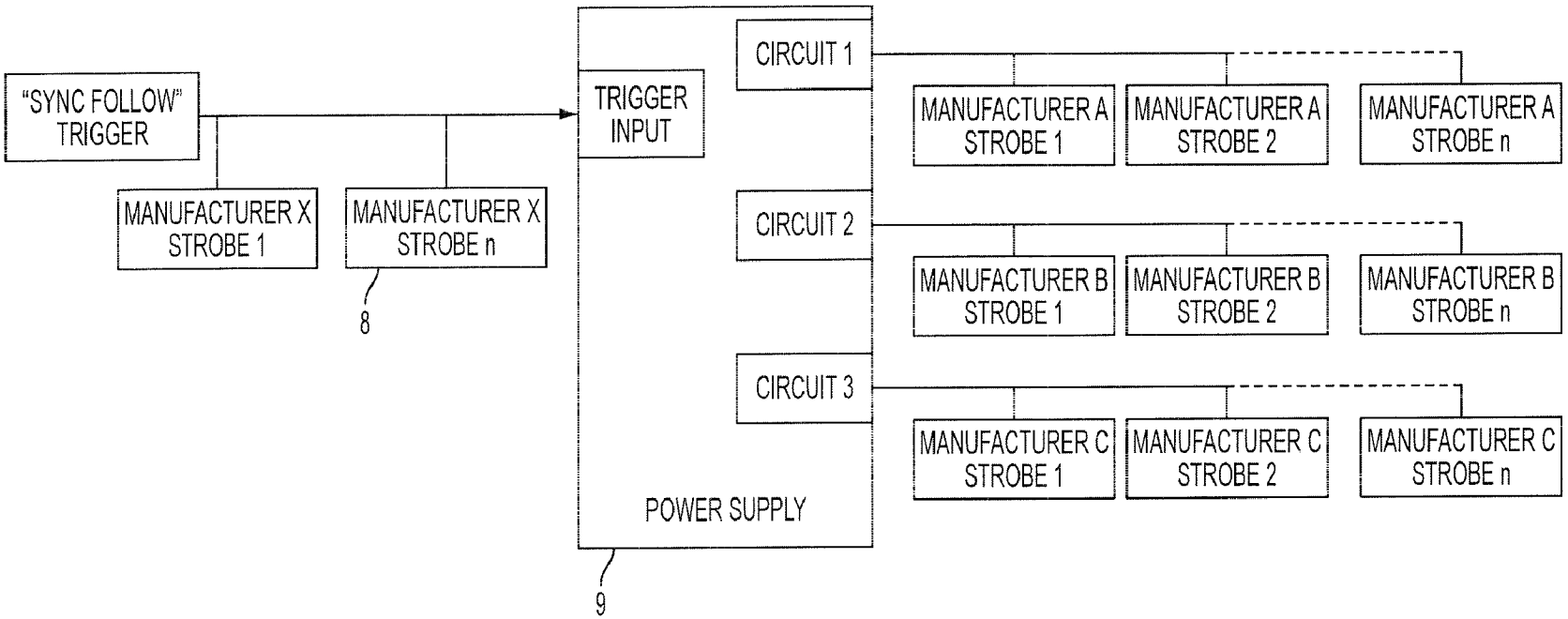
FIG. 3 provides a block diagram of an alternative embodiment of a control system utilizing a sync pulse trigger.
Figure 4:
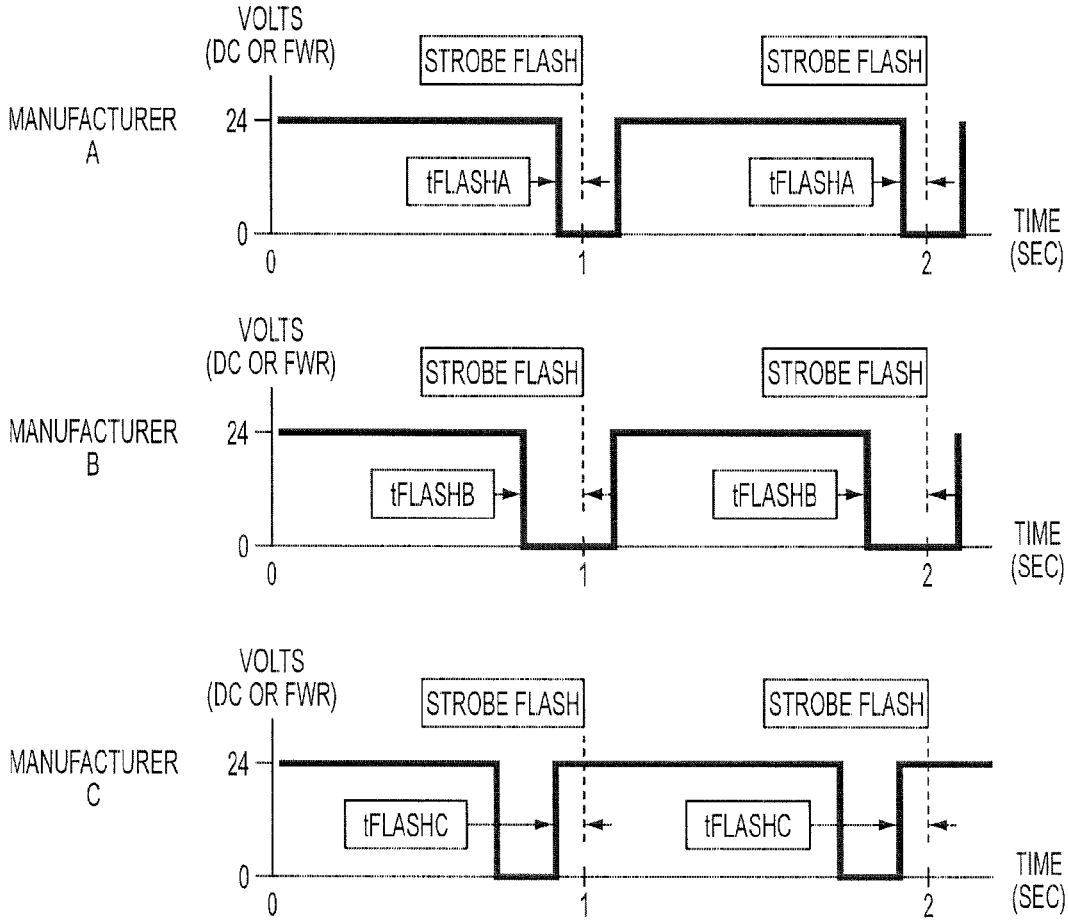
FIG. 4 provides a graphical representation showing synchronization of strobe flashes utilizing the pulses of FIG. 1.

The results of this disclosed synchronization system and method are graphically depicted in FIG. 4. As shown in FIG. 4, as originally manufactured, there is a timing discrepancy between the synchronization protocol of the strobe devices of Manufacturer A, Manufacturer B, and Manufacturer C. Both Manufacturer A and Manufacturer B program the timing of their respective strobe light flashes off of the start of the receipt of the sync pulse (period_start). Notably, however, the time period after the start of the receipt of the sync pulse until the strobe flash begins (tFlash) is different for each respective system. For Manufacturer C, the strobe flash is timed off the tail (period_end), instead of the start of the sync pulse. The disclosed synchronization system and method takes this information regarding the discrepancies between the timing protocol of each of said Manufacturers, and creates a unique synchronization protocol to be sent by each output circuit to each strobe channel to create a simultaneous pulse even amongst the strobe devices of different manufacturers. For example, it is determined that each strobe in the system needs to flash at one second intervals (1 second [FLASH], 2 second [FLASH]) Thus, the power system is accordingly programmed to send a unique signal to each output circuit to send down its attached signal to create synchronization amongst the disparately activated strobes. The output circuit for Manufacturer A will be programmed to send a signal of 1-+Flash A. The output circuit for Manufacturer B will be programmed to send out a signal of 1-+Flash B. The output circuit for Manufacturer C will be programmed to send out a signal of 1-+Flash C. The result will be the synchronization of pulses depicted in FIG. 3. Thus, simplified, while the sync pulse signals may be different on the different channels of strobe signaling devices, they are selected relative to each other so that the strobe flashes are aligned and flash in-sync.

In another embodiment of the disclosed synchronization system and method, the synchronization protocol (17) of the attached strobes is utilized instead of a simple on/off trigger (2) to initiate the activation of the power supply (9). Alternatively, a completely unrelated sync protocol may be utilized; however this mode of operation will generally not be preferred. Thus, in this embodiment, it is contemplated that the power supply (9) will utilize a "sync follow" algorithm. In other words, the power supply (9) will analyze the incoming signal and synchronize the output circuits (13) to meet the UL 1971, similar to the system and method of the first embodiment.

FIG. 3 provides a graphical depiction of an example of a sync-follow embodiment of the present synchronization system and method. As shown in FIG. 3, the power supply (9) is triggered with the synchronization protocol of the strobe device of Manufacturer X (8). Next, the power supply (9) analyzes the incoming signal and synchronizes the output signals to the input synchronization protocol signal that it is receiving from the device of Manufacture X (8). Thus, akin to the power supply (9) of the simple on/off trigger (2) embodiment discussed supra, the power supply (9) will cause each output circuit (13) to generate an appropriate synchronization pulse for each channel of strobe signaling devices based on the manufacturer who built the devices which are placed on that channel and the specific sync pulse signal timing methodology that particular manufacturer utilizes. An alternative triggering method that is also contemplated in this embodiment would be sending a command over a communication interface which would contain the necessary timing and protocol information.

The generalized difference between the sync-follow and the simple trigger is that the simple trigger coordinates the resultant synchronization off an arbitrary defined time schematic, e.g., 1 second, whereas the sync follow trigger coordinates the different strobe lights (Manufacturers A, B & C) to coordinate in sync with a pre-existing strobe light flash—that of Manufacturer X. Thus, the defined time schematic of the sync follow trigger embodiment is not arbitrary. A company, therefore, would be incentivized to use the sync-follow embodiment of the present system and method in retrofit applications where the majority of the strobes are from a single manufacturer, in systems where the trigger point of the manufactured strobes cannot be determined, and where a company wants to utilize its own proprietary synchronization protocol as the initial system trigger.

The requirement of the prior art to limit the synchronization system to strobes and synchronization protocol devices designed by the same manufacturer of visual notification appliances is eliminated by both the simple on/off trigger embodiment and the "sync follow" trigger embodiment of the present system and method. As depicted in FIG. 4, if the relative timing between the synchronization pulses is adjusted properly, the resulting strobe flashes can be synchronized among the visual notification appliances of several manufactures as shown. When the system is operated via the "sync follow" trigger embodiment disclosed supra, the different output circuits (13) will not only be synchronized with each other, but will also be synchronized with any visual notification appliances present which utilize the trigger input circuit for their synchronization protocol. These devices may also be attached as a channel of the power supply, or may be controlled by separate control systems. The input trigger can therefore be any one of the supported synchronization protocols which allows for new devices of a manufacturer to be included and synchronized with existing devices which may already be in place.

Figure 8:
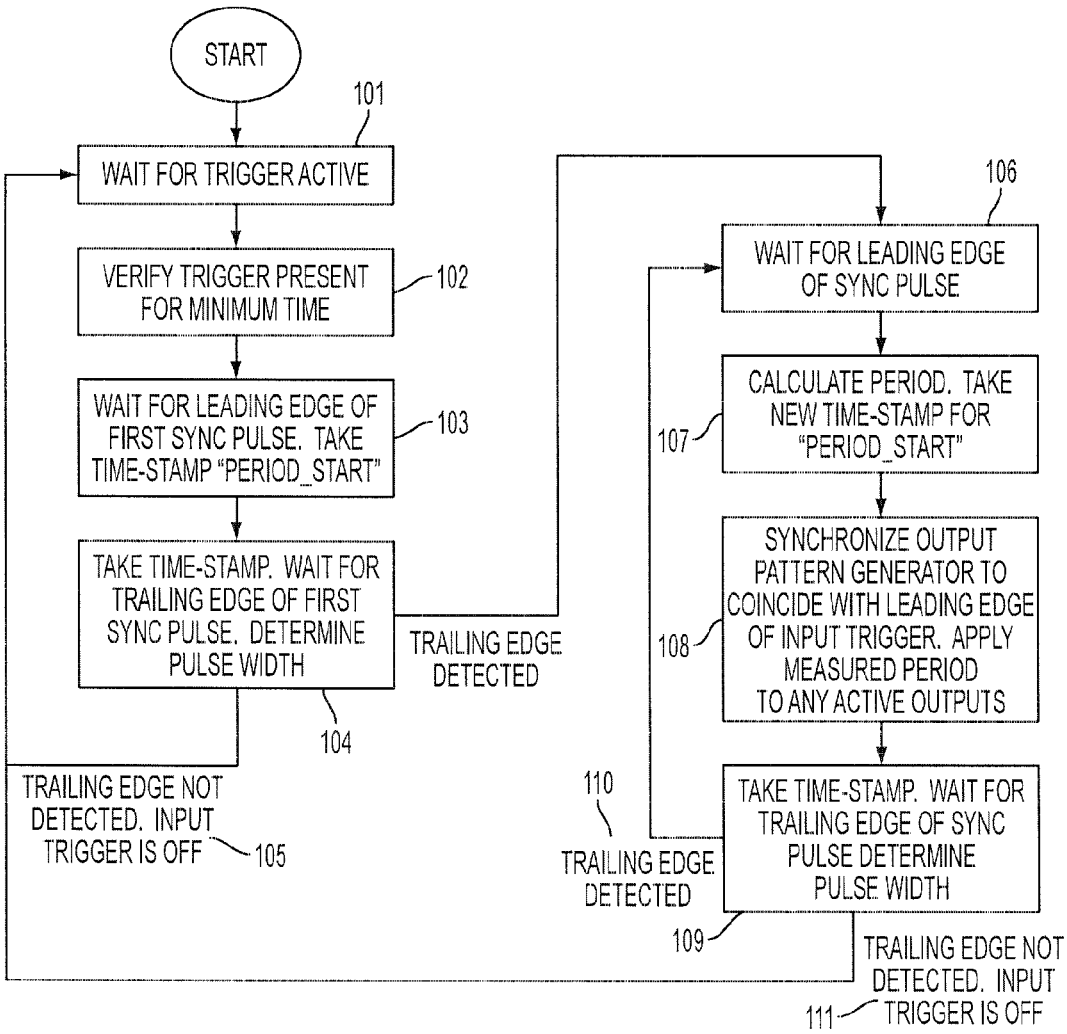
FIG. 8 provides a flowchart of an embodiment of the operation of a sync follower mode of operation.

In an alternative environment, a trigger pulse may be used which may be unrelated to any of the devices. This can also be particularly useful in the retrofit situation as in this case the control of a new supplier can be brought in to control existing devices, without need to replace any of the devices, even if they are from a different manufacturer(s). The input trigger will be analyzed, the period determined, and the output pattern generator will be configured to be synchronized for each of the different groups of devices as shown in the figures. FIG. 8 provides for a flow chart showing steps of one such embodiment of an operation which can provide for operation of the control system in the synchronizing signal generation. In step (101) of this embodiment, the system waits for the trigger to activate. Next, the system verifies the trigger is present for a minimum period of time (102). Then, the system waits for the leading edge of the first sync pulse, e.g., the beginning of the tFlash A period in FIG. 4, taking the time-stamp of this leading edge of the pulse as "period_start" (103). After taking the time-stamp, the system waits for the trailing edge of the first sync pulse, determining pulse width (104). If the trailing edge is not detected, then the system determines that the input trigger is off and it reverts back to step (105). If the trailing edge is detected, then the system waits for the leading edge of the sync pulse (106). Next, the system calculates the period, taking a new time-stamp for the "period_start" (107). After that, the system synchronizes the output pattern generator to coincide with the leading edge of the input trigger, applying the measured period to any active outputs (108). Then, the system takes a time-stamp, waiting for the trailing edge of the sync pulse to determine pulse width (109). If a trailing edge is detected, the system reverts back to step (106) (110). If the trailing edge is not detected, the input trigger is off and the system reverts back to step (101) (111).

Figure 1:
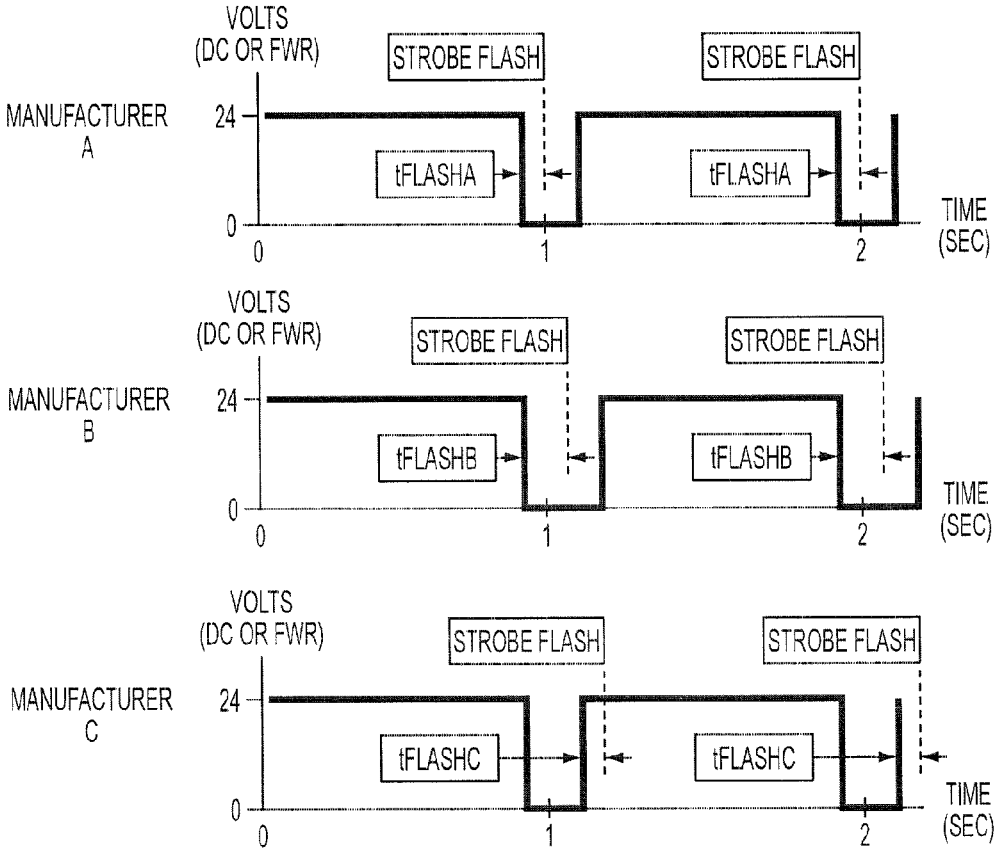
FIG. 1 PRIOR ART
FIG. 1 provides a graphical representation of the prior art relationship between synchronization pulses and resulting strobe flash for three different hypothetical strobe systems.
Figure 5:
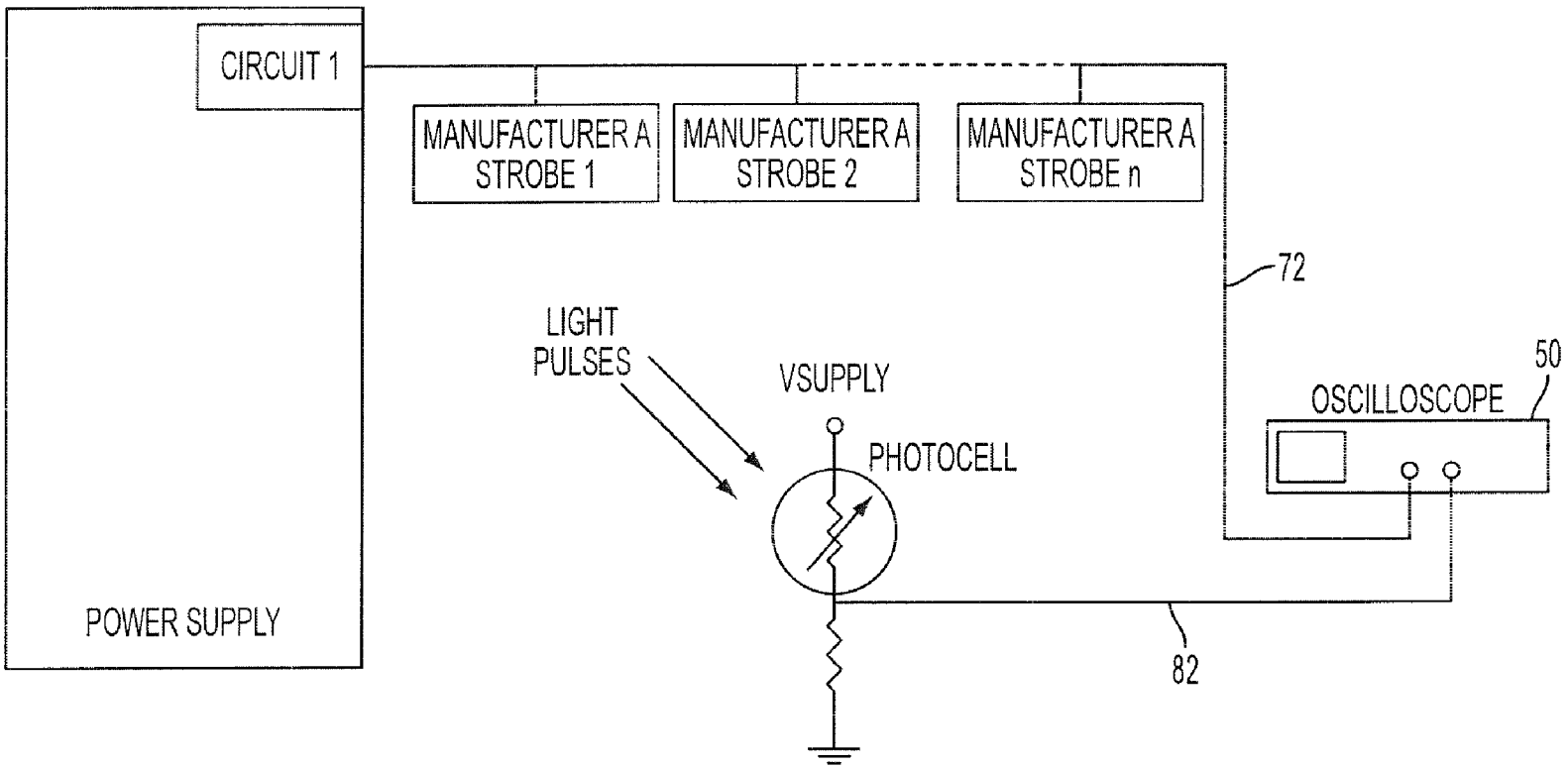
FIG. 5 provides a block diagram of a test fixture to determine the timing of a variety of different strobes.
Figure 6:
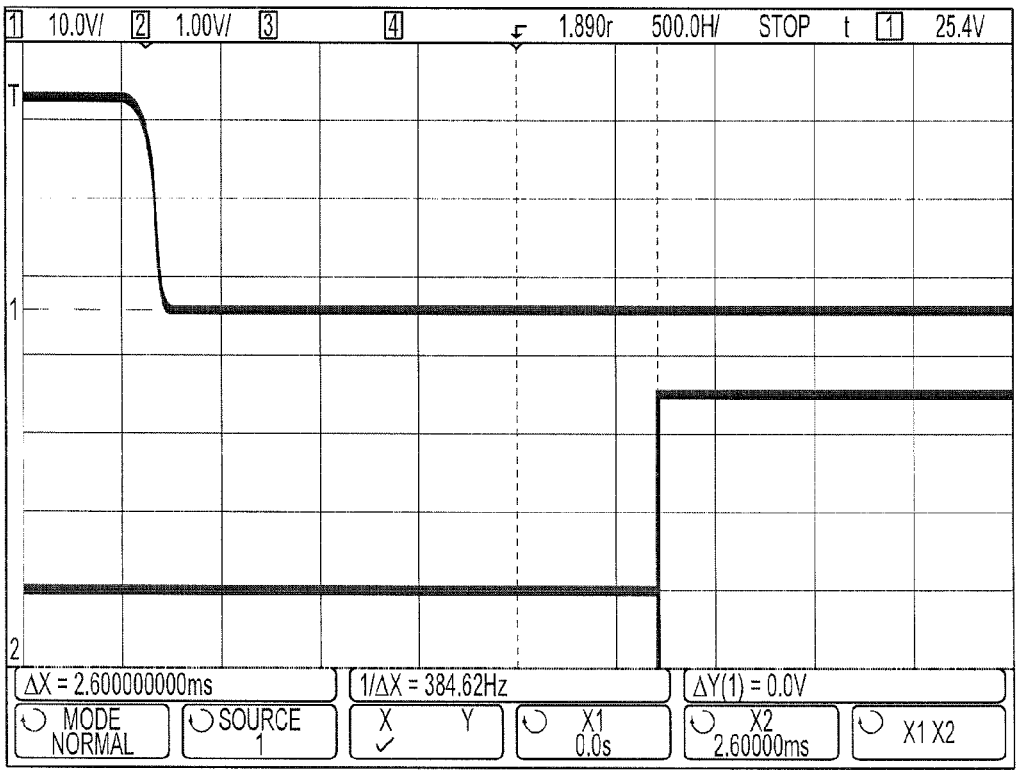
FIG. 6 provides a sample output screen from the fixture of FIG. 5.

It is also important to note that, in order to determine the necessary signal to be generated, it will often be the case that it may be necessary to determine how the synchronization protocol of the different manufactured strobe devices (40), (50) and (60) works. Thus, there is also described herein a method and system for determining the sync timing of an unknown strobe device. Such information may not be publicly available, or may have been lost over time. Further, sometimes the manufacturer simply does not publish enough detail regarding the performance of their particular strobe devices. Because of the general requirement of knowing what the synchronization protocol is for the systems and methods disclosed herein, it may be necessary in some environments to empirically determine the "tFlash" value (such as is indicated in FIGS. 1 and 4) and to determine whether this timing value is based on the leading or trailing edge of the synchronization pulse. In order to accomplish this, the present application discloses, as depicted in FIG. 5, a fixture which allows an oscilloscope (50) to be used to capture both the synchronization pulse (72) and the resulting strobe flash (82) to determine the tFlash value. Generally, it is contemplated that the synchronization pulse will be captured in the same manner as disclosed in the simple on/off trigger embodiment and the "sync follow" trigger embodiment. Further, it is generally contemplated that the resultant strobe flash/light pulses will be captured in a photocell, or similar light capturing mechanism known to those of skill in the art and transferred to the oscilloscope (50). While an oscilloscope is disclosed in FIG. 5, it should be noted that any similar type of electronic test instrument is contemplated in this disclosure. A sample oscilloscope (50) capture is shown in the graph of FIG. 6.

Figure 7:
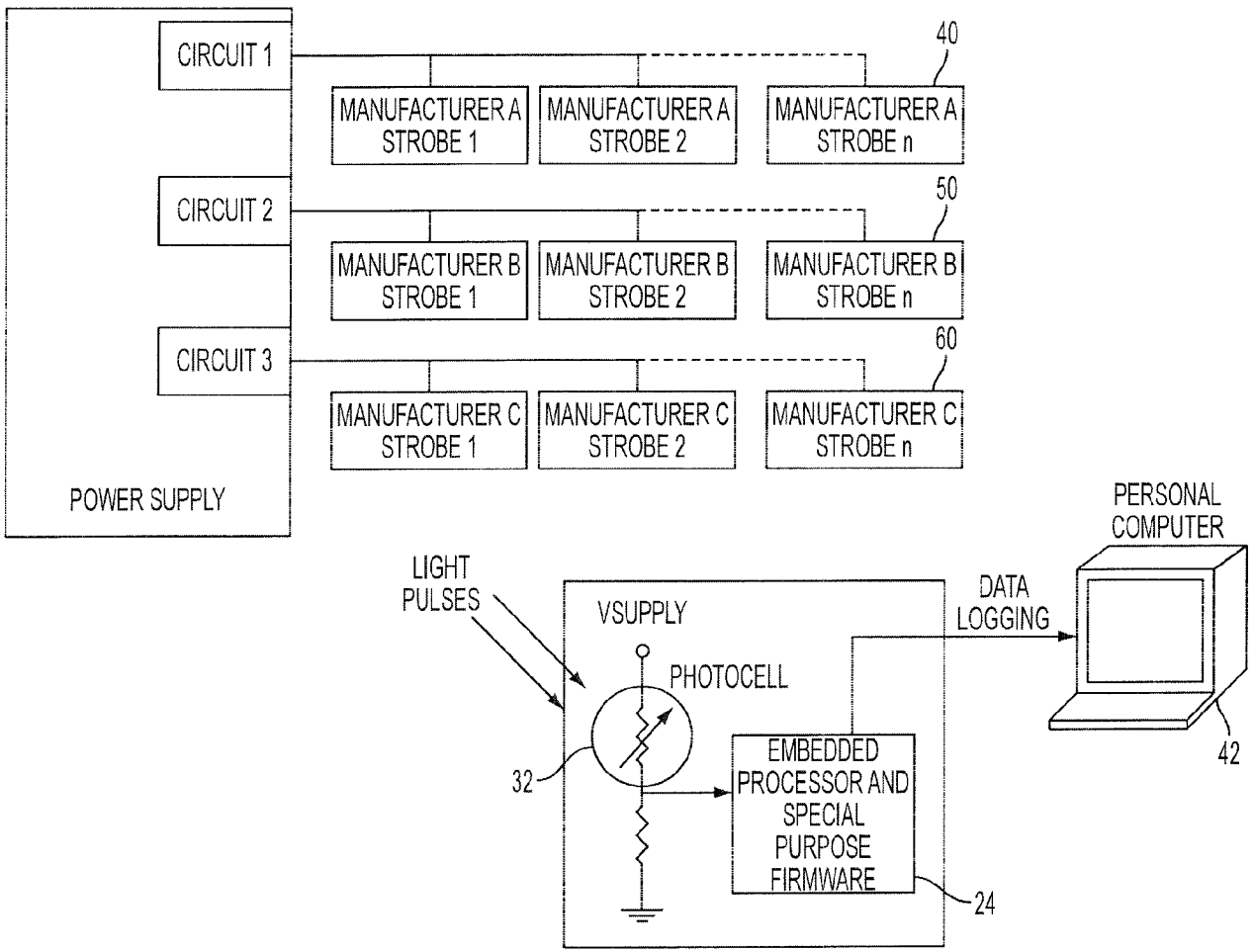
FIG. 7 provides a block diagram of an embodiment of a verification fixture.

Further, since no generally available test equipment exists to verify compliance with UL 1971 requirements, also disclosed in the present application is equipment which was developed for this purpose. In this equipment, the concept of a photocell (32) or similar light pulse capturing equipment known to those of skill in the art, is utilized in conjunction with an embedded processor and special purpose hardware (24) to receive and analyze the photocell output and verify compliance. As depicted in FIG. 7, the photo sync tester (32) detects incoming light flashes from the strobe devices (40), (50), and (60), and analyzes their flash rate and timing Next, the resulting measurements and pass/fail determination made by the processor's (24) analysis of said flash rate and timing is logged to a personal computer (42) or similar data storing device known to those of skill in the art for storage and later analysis.

While the invention has been disclosed in conjunction with a description of certain embodiments, including those that are currently believed to be the preferred embodiments, the detailed description is intended to be illustrative and should not be understood to limit the scope of the present disclosure. As would be understood by one of ordinary skill in the art, embodiments other than those described in detail herein are encompassed by the present invention. Modifications and variations of the described embodiments may be made without departing from the spirit and scope of the invention.

The invention claimed is:

1. A device for the creation of a synchronization protocol for the synchronization of strobe lights comprising:

a programmable power supply system programmed to provide a synchronization protocol for each of a plurality of channels, each of said channels having a plurality of strobe lights thereon, said power supply including a plurality of circuits, each of said circuits linked to one of said channels; and a trigger signal input into said power supply system;

wherein when said trigger signal is received, said plurality of circuits are activated;

wherein each of said circuits transmits said synchronization protocol on the channel linked thereto, each of said synchronization protocols being different;

wherein each of said synchronization protocols instructs strobe lights on the linked channel to strobe; and wherein said synchronization protocols result in all said strobe lights in all said channels flashing in sync.

2. The device of claim 1, wherein the trigger signal is an on/off trigger.

3. The device of claim 1, wherein the trigger signal is a sync follow trigger.

4. The device of claim 1, wherein each of said synchronization protocols generated by said circuits will meet the UL 1971 timing requirements for all of said strobe lights.

5. The device of claim 1 wherein strobe lights on a first channel in said plurality of channels are from a different manufacturer than strobe lights on a second channel in said plurality of channels.

6. The device of claim 1 wherein strobe lights on a first of said channels strobe relative to a different part of said synchronization protocol transmitted on said first channel, compared to strobe lights on a second of said channels.

7. A method of synchronization protocol for the synchronization of strobe lights comprising:

determining timing discrepancy between sync pulse signal timing methodologies of different strobe lights;

taking said determination of the timing discrepancy and using it to program a power supply to indicate a unique synchronization protocol signal to each of a plurality of circuits, each protocol signal being different and specific to a channel of strobe lights attached to each of said circuits;

activating a trigger;

activating said circuits through the activation of said trigger; and generating said unique synchronization protocol signal from said circuits for each of said channels based on the specific sync pulse signal timing methodology used by strobe lights on that channel;

wherein said unique synchronization protocols from said each of said circuit for each of said channels causes all said strobe lights in all said channels to flash in sync.

8. The method for creating a synchronization protocol of claim 7, wherein each of said synchronization protocols generated by said output circuits will meet the UL 1971 timing requirements for all of said strobe lights.

9. The method of claim 7 wherein strobe lights on a first channel in said plurality of channels are from a different manufacturer than strobe lights on a second channel in said plurality of channels.

10. The method of claim 7 wherein strobe lights on a first of said channels strobe relative to a different part of said synchronization protocol transmitted on said first channel, compared to strobe lights on a second of said channels.

* * * * *